US005499621A

United States Patent [19]

Trihey

[11] Patent Number: 5,499,621

[45] Date of Patent: Mar. 19, 1996

[54] HOT WATER HEATERS

[75] Inventor: John M. Trihey, Victoria, Australia

[73] Assignee: Aqua Max Pty Ltd., Moorabbin, Australia

[21] Appl. No.: 291,511

[22] Filed: Aug. 15, 1994

Related U.S. Application Data

[62] Division of Ser. No. 775,977, Oct. 29, 1991, Pat. No. 5,361,729.

[30] Foreign Application Priority Data

Apr. 19, 1989 [AU] Australia ..... PJ3790
Dec. 18, 1989 [AU] Australia ..... PJ7895

[51] Int. Cl.[6] ..... F24H 1/00

[52] U.S. Cl. ..... 126/361; 122/17; 431/286; 239/553; 239/566

[58] Field of Search ..... 122/17, 14; 126/361; 239/553, 566, 552; 431/286

[56] References Cited

U.S. PATENT DOCUMENTS

| | | | |
|---|---|---|---|
| 672,748 | 4/1901 | Allen | 239/566 |
| 873,624 | 12/1907 | Springer et al. | 239/566 |
| 5,146,911 | 9/1992 | Adams | 126/361 |

FOREIGN PATENT DOCUMENTS

| | | | |
|---|---|---|---|
| 297336 | 3/1954 | Switzerland | 239/552 |

*Primary Examiner*—Carroll B. Dority
*Attorney, Agent, or Firm*—Ross, Ross & Flavin

[57] ABSTRACT

A hot water heater capable of delivering a relatively large quantity of hot water, the quantity being larger than the total volume of the storage capacity of the heater is disclosed.

The hot water heater comprises a vessel having an inlet port and an outlet port, a cold water inlet coupled to the inlet port, a hot water outlet line coupled to the outlet port, with heating means for heating water in the vessel, and control means for establishing a flow path between the inlet and outlet lines. The arrangement is such that water flowing in the inlet line is divided between the flow path and inlet port in a predetermined ratio whereby water flowing in the outlet line is, in use, colder than the water passing through the outlet port.

The control means is arranged to store hot water in the vessel at a higher temperature than is normally required in the outlet line and the cold water which passes through the flow path reduces the temperature of the water in the outlet line but increases the effective volume of hot water flowing from the heater.

3 Claims, 10 Drawing Sheets

FIG 14
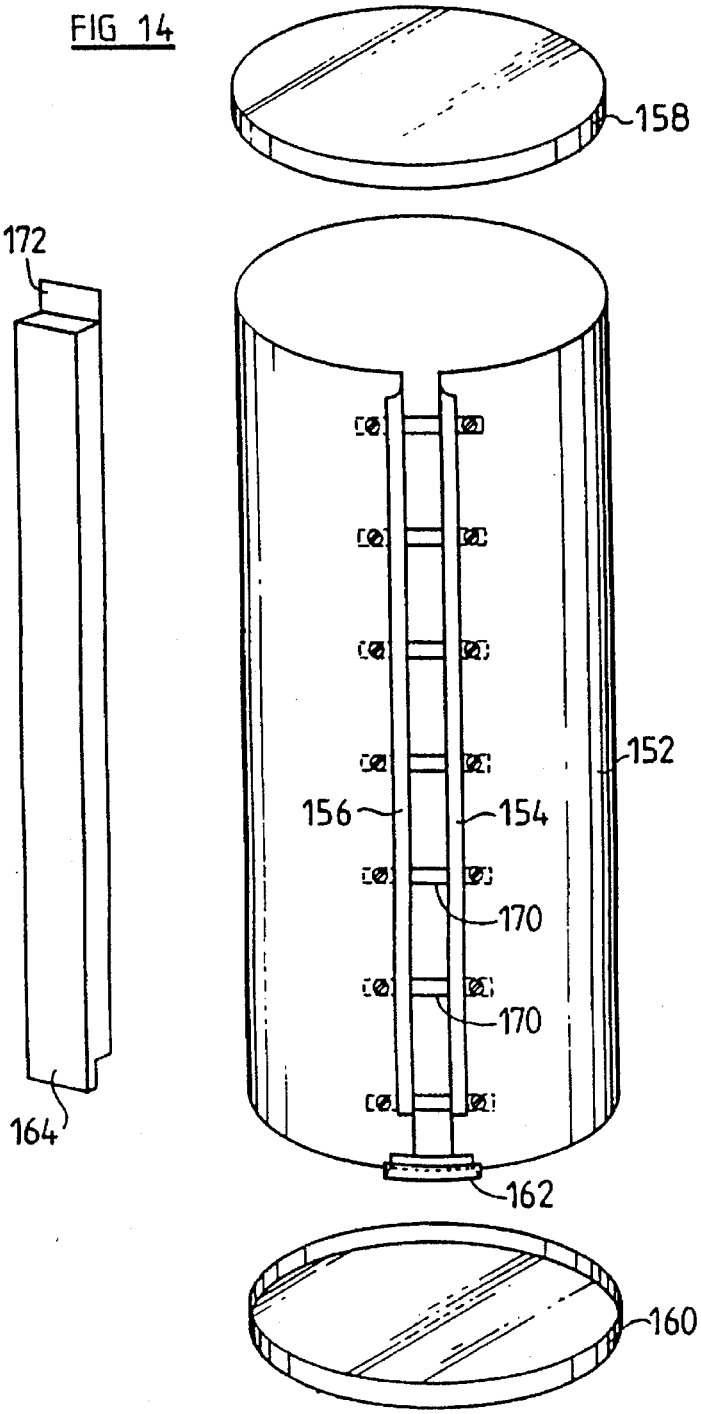
FIG 15
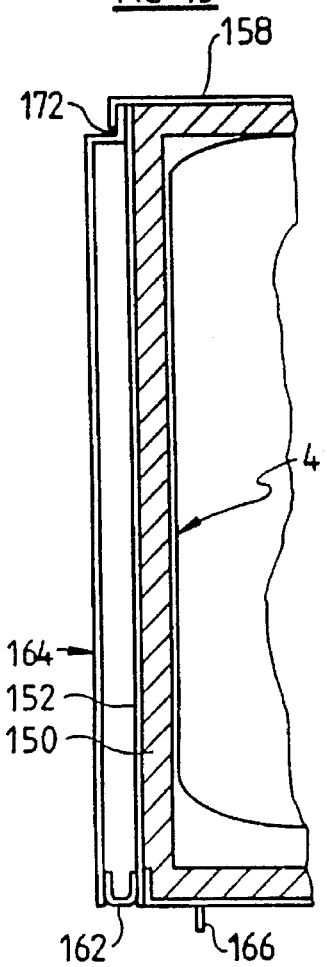
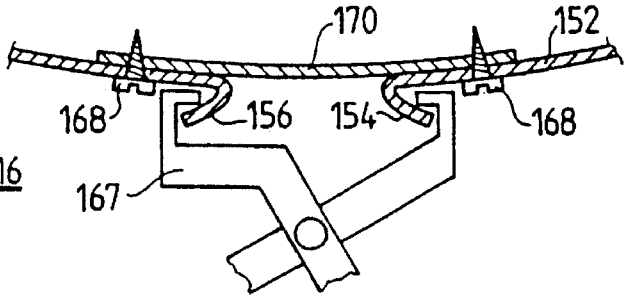
FIG 16

HOT WATER HEATERS

This application is a division of application No. 07/775977, filed Oct. 29, 1991, and now U.S. Pat. No. 5,361,729, (status, abandoned, pending).

This invention relates to hot water heaters particularly but not exclusively to hot water heaters which can be used in domestic hot water systems.

The first object of the invention is to provide a novel hot water heater which is capable of delivering a relatively large quantity of hot water, the quantity being larger than the total volume of the storage capacity of the heater.

According to a first aspect of the invention there is provided a hot water heater comprising a vessel having an inlet port and an outlet port, a cold water inlet coupled to the inlet port, a hot water outlet line coupled to the outlet port, heating means for heating water in the vessel, and control means for establishing a flow path between the inlet and outlet lines, the arrangement being such that water flowing in said inlet line is divided between the flow path and said inlet port in a predetermined ratio whereby water flowing in the outlet line is, in use, colder than the water passing through the outlet port.

In use the control means is arranged to store hot water in the vessel at a higher temperature than is normally required in the outlet line and the cold water which passes through said flow path reduces the temperature of the water in the outlet line but increases the effective volume of hot water flowing from the heater.

Preferably, the control means comprises a tube of relatively narrow bore. This arrangement has the advantage of simplicity reliability and cheapness. In the arrangement of the invention, the tube does not include a thermostatically controlled valve. It may, however, include a non-thermostatically controlled valve which can be preset, by the manufacturer or by the user, to control the resistance to fluid flow in said path thereby enabling the temperature of the water in the outlet line to be controlled.

Another object of the invention is to provide a gas hot water heater which has a removable panel to provide access to the working components of the heater.

According to a further aspect of the invention there is provided a gas fired hot water heater including a gas burner and a balanced flue, said flue including an air inlet chamber into which air for said burner passes, characterised in that the chamber includes a removable panel which, when removed, affords access to at least said burner. Preferably, the heater includes a thermostatically controlled gas valve and wherein said panel, when removed, affords access to said gas valve.

A further object of the invention is to provide a storage electric hot water heater which can be used in a system having a night rate control, the heater including a number of heating elements which are selectively engergised so as to tend to avoid peak loading of the electric supply system when the night rate becomes operative.

According to a further aspect, the invention provides a vessel, first and second heating elements located near the lower end of the vessel and control means for selectively energising the first element, second element, or first and second elements, in accordance with the level of hot water in the vessel.

Preferably the control means includes temperature sensing elements located at spaced locations on the vessel.

According to a further aspect of the invention there is provided a method of controlling an electric hot water heater comprising the steps of sensing the temperature of water in a vessel at selected locations on the vessel and controlling the energisation of first and second elements in accordance with temperatures sensed by said elements, the method being such that one or other or both of the elements are energised.

According to a further aspect of the invention there is provided a method of forming a housing on a body, said method including the step of providing a pair of flanges on opposed edges of a cladding sheet, placing a body in the cladding sheet, applying a clamping force through the opposed flanges to draw them towards one another and utilising fixing means to hold the cladding sheet snugly on the body.

According to a further aspect of the invention there is provided a hot water heater comprising a vessel for water, heating means for applying heat to one side of the vessel for heat transfer to water in the vessel adjacent to said one side to thereby establish a convection current in the water from said one side to the top of the vessel.

In the heater defined above, the convection current tends to form a circulating current of water. This results in mixing of the water within the vessel to thereby establish a generally uniform temperature throughout the water.

According to a further aspect of the invention there is provided a hot water heater comprising a vessel for containing water, a gas burner for heating the vessel, means for directing combustion gases adjacent to the sides of the vessel and towards the top of the vessel and shielding means for shielding the upper part of the vessel to thereby prevent overheating of water adjacent to the upper part of the vessel.

The provision of shielding means at the upper part of the vessel tends to stop transfer of heat to the water at the upper part of the vessel where the water is normally hottest. This thereby tends to prevent overheating or boiling of the water at this point.

According to a further aspect of the invention there is provided a gas burner comprising a generally wedge shaped body having a row of outlet orifices adjacent the narrower end of the wedge shaped body.

The invention will now be further described with reference to the accompanying drawings, in which:

FIG. 14 is an exploded view showing part of an assembly technique of the invention;

FIG. 15 is a longitudinal cross-section through an outer housing;

FIG. 16 shows the use of a clamp during assembly of the housing;

Figure 1:
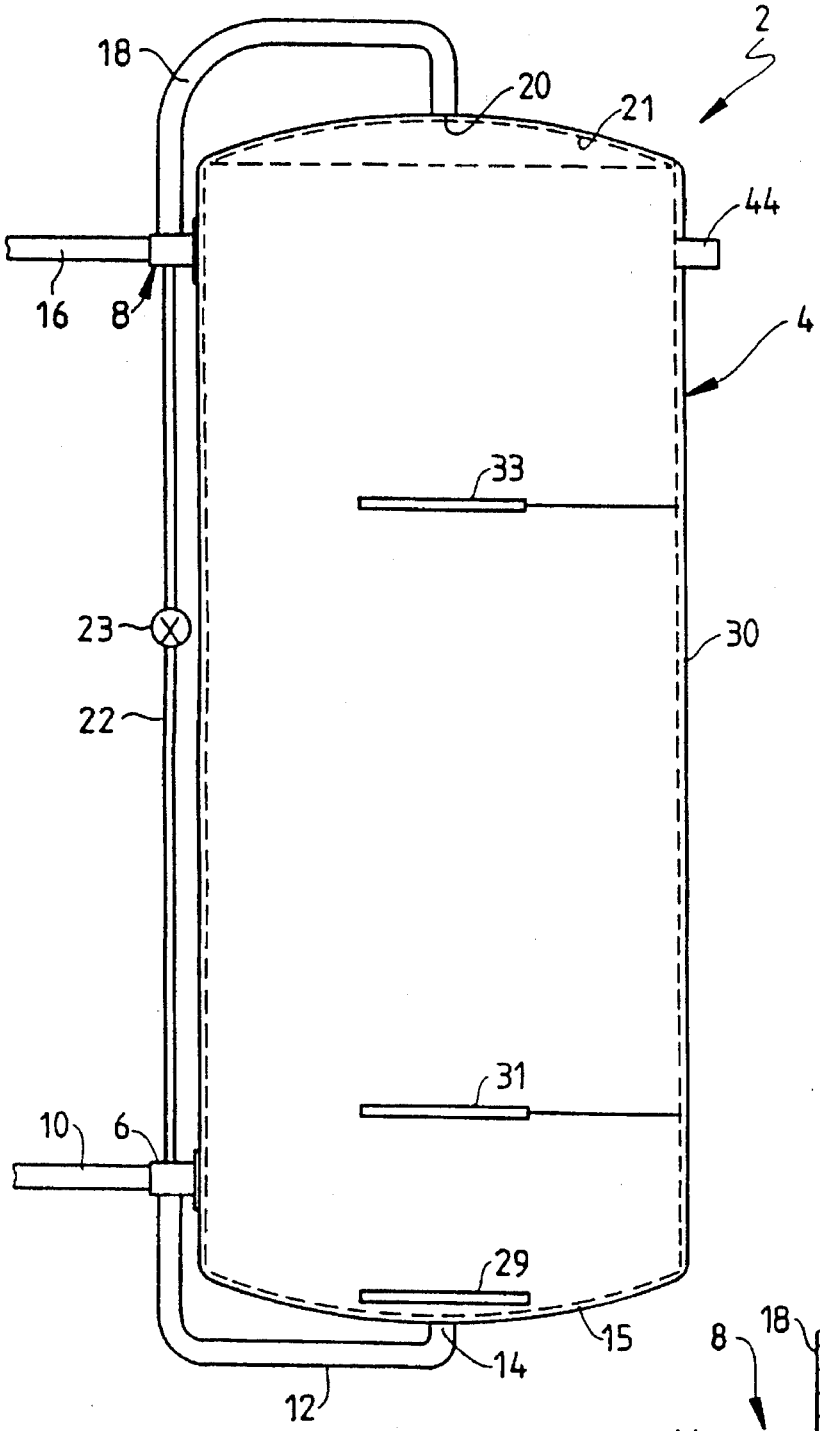
FIG. 1 is a schematic view through an electric hot water heater.

FIG. 1 is a schematic diagram illustrating a hot water heater 2 constructed in accordance with the invention. The hot water heater 2 includes a vessel assembly 4 which is capable of withstanding the pressure of a domestic water supply. The heater 2 includes an inlet fitting 6 and an outlet fitting 8. The inlet fitting 6 is coupled to a cold water line 10 and To inlet conduit 12 which extends from the fitting 6 to an inlet port 14 located in a curved bottom wall 15 of the vessel 4. The outlet fitting 8 is coupled to a hot water outlet line 16 and to a hot water conduit 18 which extends from the fitting 8 to an outlet port 20 formed in a curved top wall 21 of the vessel 4. A bypass tube 22 extends between the fittings 6 and 8.

Figure 2:
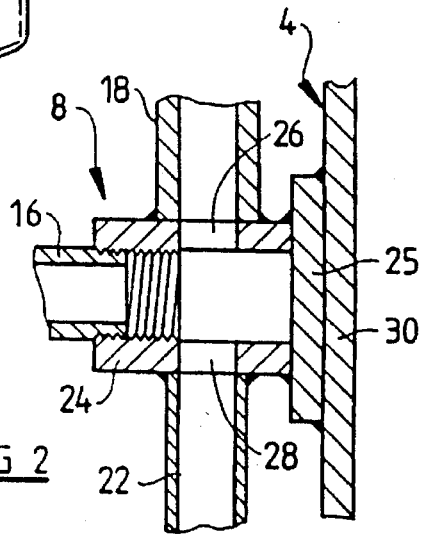
FIG. 2 is a more detailed cross-section through an outlet fitting.

As best seen in FIG. 2, the outlet fitting 8 comprises a hollow cylindrical body 24 which is welded to a plate 25 which in turn may, optionally, be welded to the vessel 4 at its closed end to anchor it. The hot water outlet line 16 is connected to the other end of the body 24. The conduit 18 is welded to one side of the body 24 and communicates with its interior via an opening 26. The bypass tube 22 is welded to the opposite side of the body 24 and communicates with its interior via an opening 28. The inlet fitting 6 is of analogous construction and need not be described in detail.

The heater includes a baffle 29 located inwardly adjacent to the inlet port 16, the baffle serving to reduce turbulence in the vessel on entry of cold water through the port 14. Thus, the temperature of the water within the vessel will be stratified, the hottest water being near the top end wall 21. The heater includes an electric heating element 31 in the vessel near the bottom thereof. The heater may also include a booster element 33 located towards the upper part of the vessel. The booster element 33 may be operated when the level of cold water within the vessel approaches or exceeds the booster element.

The hot water heater includes control means (not shown in FIGS. 1 and 2) for thermostatically controlling the operation of the elements 31 and 33. Generally speaking, the control means is such that the element 31 is operated so as to achieve a predetermined temperature of water within the vessel. This for instance may be set at a high level say for instance 75° C. to 80° C. which is much higher than the hot water delivery temperature required in the outlet line 16. When hot water is drawn from the line 16, cold water will flow through the line 10 into the inlet fitting 6. A predetermined proportion of the cold water will pass into the bypass tube 22 and thus into the outlet fitting 8. This cold water is mixed with that flowing through the conduit 18 and therefore the temperature of the water in the line 16 is lowered by a predetermined amount. Thus, the provision of the tube 22 effectively enables a greater volume of hot water to be supplied to the outlet line 16 than the total capacity of hot water within the vessel 4. It will be appreciated that the amount of fluid flowing through the bypass 22 depends on the resistence to flow presented by the tube 22 as compared to the conduits 12 and 18. In a typical arrangement, it would be desirable to arrange for about one quarter of the flow to enter the tube 22, the remaining portion of the flow entering the conduit 12. This can be simply accomplished by arranging for the tube 22 to have a relatively narrow diameter say three-eighths of an inch whereas the conduit 12 is of one half inch diameter. If the water stored in the vessel 4 is at 80° C., and the inlet water temperature is 15° C., water will be delivered from the outlet line 16 at about 65° C., for instance at 67° C. If the vessel 4 has a nominal volume of 315 liters, approximately 420 liters of water can be delivered at about 65° C. from the line 16. The tube 22 may include an adjusting valve 23 which is manually settable to alter the resistance to flow through the tube 22. The valve thus alters the temperature and volume of water available to the user. The control knob (not shown) is preferably located near the thermostat control which is accessible to the user.

A prototype water heater of the invention has been constructed and the table below illustrates the performance of the prototype.

| | TEMPS °C. | | |
|---|---|---|---|
| Time Mins | Outlet Line 16 | Vessel 4 | Inlet Line 10 |
| | FLOW RATE 12.5 L/MIN | | |
| 0 | 30.8 | 30.0 | 19.4 |
| 1 | 60.0 | 75.5 | 18.0 |
| 2 | 60.0 | 75.7 | 17.8 |
| 3 | 59.8 | 75.6 | 17.8 |
| 4 | 59.8 | 75.6 | 18.0 |
| 5 | 59.7 | 75.5 | 18.0 |
| 6 | 59.7 | 75.5 | 18.1 |
| | FLOW INCREASED TO 22.75 L/MIN | | |
| 7 | 59.0 | 75.4 | 18.8 |
| 8 | 59.2 | 75.2 | 18.7 |
| 9 | 58.8 | 75.0 | 18.0 |
| 10 | 58.5 | 75.0 | 17.2 |
| 11 | 58.4 | 75.0 | 17.0 |
| | FLOW REDUCED TO 4.55 L/MIN | | |
| 12 | 60.2 | 74.9 | 17.0 |
| 13 | 60.0 | 74.7 | 17.0 |
| 14 | 60.0 | 74.6 | 17.0 |
| 15 | 60.0 | 74.7 | 17.0 |
| 16 | 60.0 | 74.6 | 17.0 |
| | FLOW INCREASED TO 12.5 L/MIN | | |
| 20 | 58.4 | 74.5 | 16.8 |
| 25 | 58.2 | 74.2 | 16.7 |
| 30 | 57.8 | 73.8 | 16.7 |
| 34 | 53.2 | 67.7 | 16.8 |

TOTAL WATER from outlet line 16: 436 L at an average temperature of 59° C.

In FIG. 1, the vessel assembly 4 comprises a cylindrical sidewall 30 which is made from relatively thin corrosion resistant sheet material, for instance stainless steel of a thickness of 0.9 mm.

Figure 3:
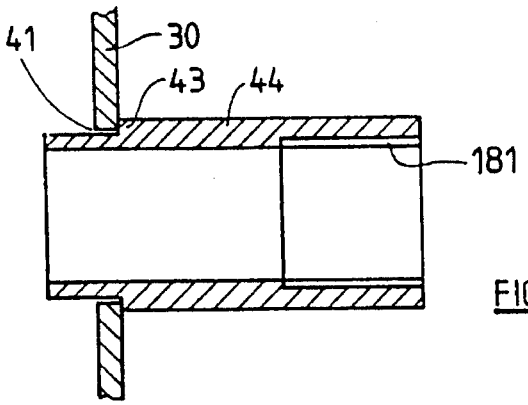
FIGS. 3 to 6 are fragmentary sectional views of the formation of a tubular inlet/outlet socket.
Figure 4:
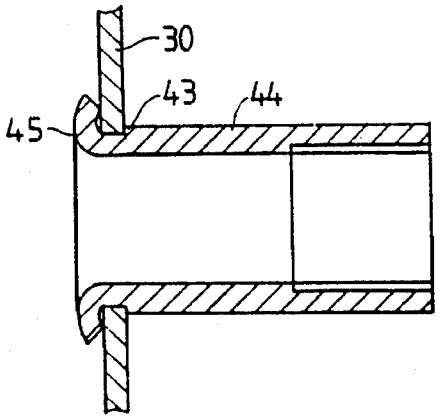
Figure 5:
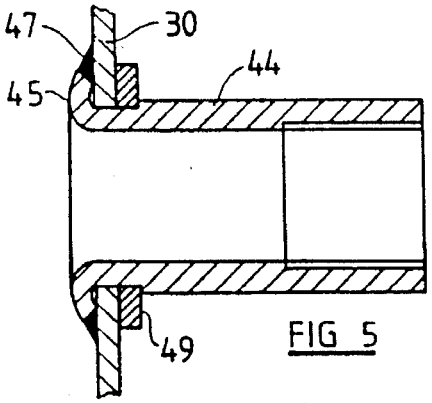

FIGS. 3 to 6 show an arrangement for mounting of a socket 44 which in use receives a conventional pressure relief valve (not shown) or other conduit or fitting. The inner end of the socket 42 passes through an opening 41 in the sidewall 30 until a shoulder 43 abuts the sidewall as shown in FIG. 3. The inner end is swaged or pressed flat to form a flange 45 which bears against the inside face of the sidewall 30 as shown in FIG. 4. The flange 45 is then welded to the cylindrical body 30 as shown by weld 47 in FIG. 5. This technique enables a simple but strong mounting arrangement for the socket 44.

The pressure relief valve or other component can be mounted on the socket 44 for instance by means of an internal thread 181 of the socket 44, or by other means.

Instead of welding, a sealing washer, for instance of fibrous material, may be used between the flange 45 and the cylindrical body 30 (not shown).

Where welding is used, it is desirable to put a support washer 49, for instance of steel or like material, between the shoulder 43 and the cylindrical body 30 to act to support the welding region during the welding process.

Figure 5A:
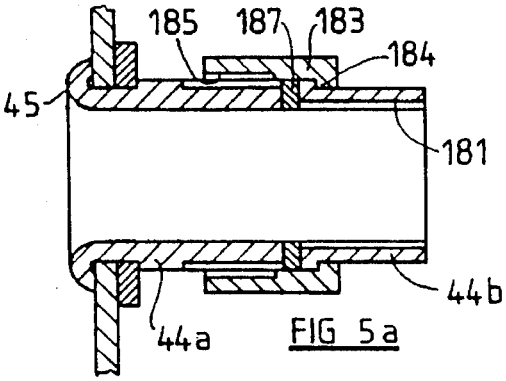

Referring to FIG. 5*a*, in a further alternative arrangement, the main body of the socket 44 is formed in two parts, a first part 44*a* having the flange 45 formed thereon, and a second part 44*b* having means such as an internal thread 182 for mounting the pressure relief valve or other component on the socket 44. The first and second parts 44*a*, 44*b* are secured together by means of a nut 183 having an inturned flange 184 at one end and an internal thread 185 extending in a region away from the flange 184. A shoulder 186 on the second part 44*b* co-operates with the inturned flange 184 so that the second part 44*b* can be clamped against the first part 44*a* by the nut 183, sealing means 187 such as a washer being provided between the two parts 44*a*, 44*b*.

The two-part embodiment of the socket 44 shown in FIG. 5*a* has the advantage that the pressure relief valve or other component can-be mounted on the second part 44*b* of the socket 44 when independent of the first part 44*a*. The valve, already assembled on the internally screw-threaded portion of the socket 44, can then be mounted with respect to the sidewall 30 by simply applying the nut 183.

Figure 6:
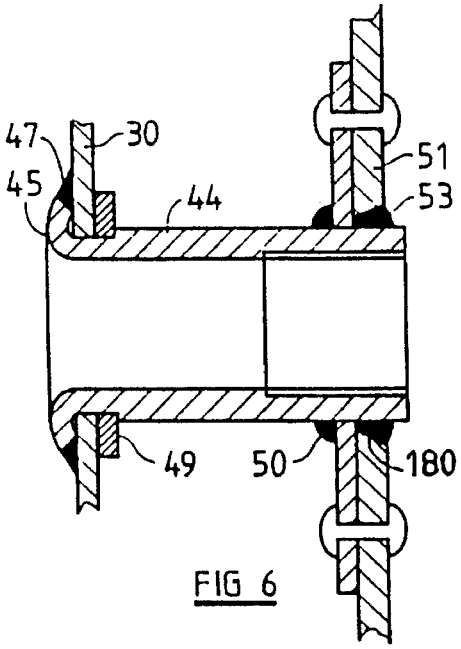

FIG. 6 shows the outer end of the socket 44 passing through an opening 180 in a sheet metal housing 152 of the heater. A large washer 51 is welded to the socket 44 by welding material 50, and riveted to the housing 152 so that the inner periphery of the washer 51 provides support for the socket 44 so as to prevent damage thereto during installation of the heater. A bead 53 of sealant can be applied to the gap, if present between the housing 152 and the outer surface of the socket 44.

Figure 7:
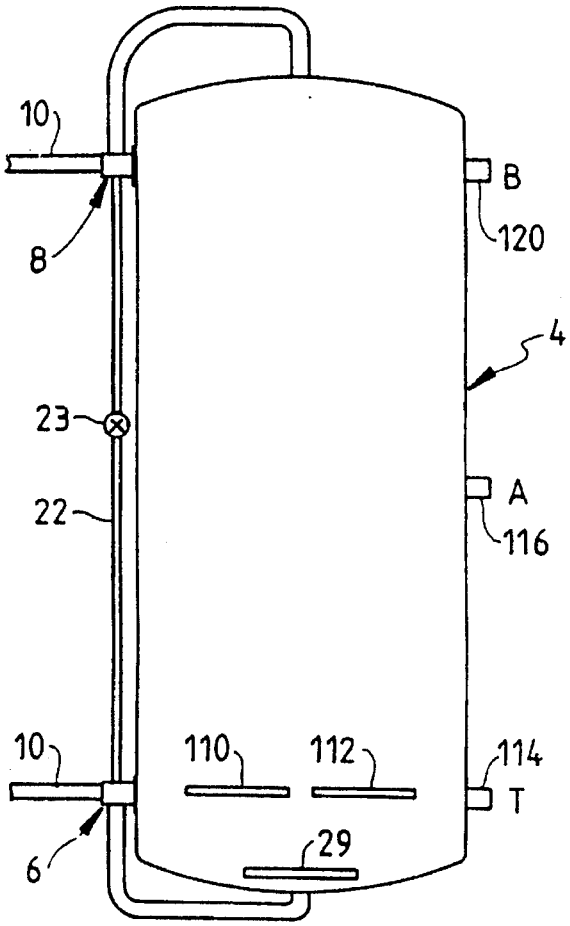
FIG. 7 is a simplified view of a hot water heater having a first configuration of temperature sensing elements.
Figure 8:
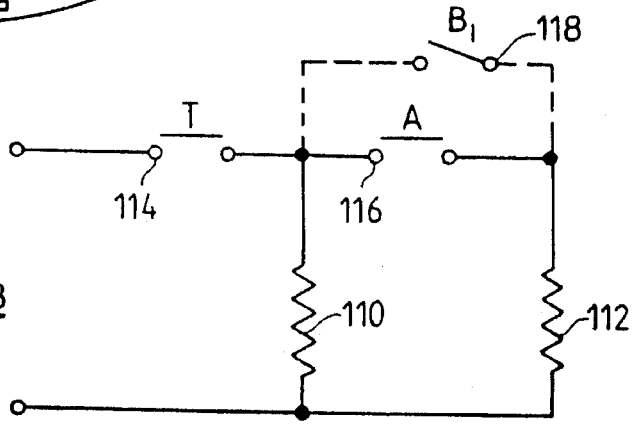
FIGS. 8 and 9 are circuit diagrams for the arrangement illustrated in FIG. 7.

FIGS. 7 and 8 diagrammatically illustrate a hot water heater provided with two heating elements 110 and 112 which can be independently controlled, in place of the customary single element. The elements 110 and 112 may have a capacity of say 2.4 kw each.

The control circuitry associated with the elements 110 and 112 includes a first thermostatically controlled switch 114 located near the bottom of the vessel 4 and a second thermostat switch 116 located near the middle of the vessel. The circuit diagram of FIG. 8 diagrammatically illustrates the control arrangement. It will be seen that the heating elements 110 and 112 are connected in parallel via the thermostat switch 114. The thermostat switch 116 is connected in series with the parallel pair. An optional bypass switch 118 can be connected across the switch 114 to effectively bypass it so that both elements can be simultaneously activated on closing the bypass switch 118, subject of course to the thermostatic control of the switch 114. The switch 114 is set so that it is normally closed at 65° C. and below and opens above 75° C. The switch 116 however is arranged to open at 70° C. and close below 40° C. It will be appreciated that if the vessel is about half full of hot water and half full of cold, the switch 116 will be open and the element 110 will be activated and the element 112 unactivated. Activation of the element 110 will of course be subject to the control of the thermostat switch 114. If the mains supply system to the appliance includes a night switch it will be appreciated that when the night switch comes on, only the element 110 will be operated if there is a significant volume of hot water in the tank. If on the other hand the switch 116 is adjacent to cold water in the tank, the switch will be closed and both elements will be operated. This provides increased power to heat all of the cold water in the tank during the night switch on period.

Figure 9:
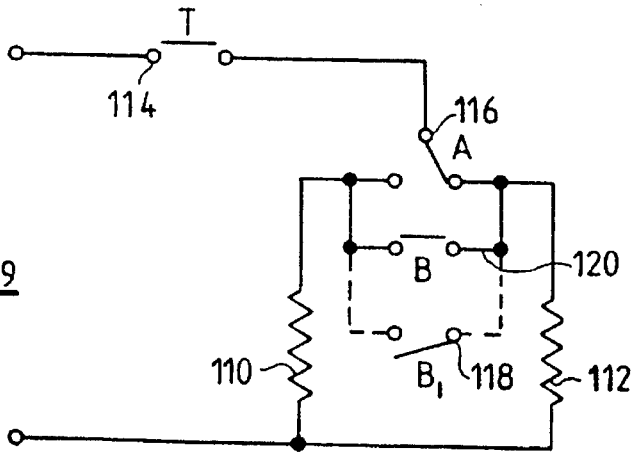

FIGS. 7 and 9 illustrate a modified arrangement. In this arrangement, a third thermostat switch 120 is located near the top of the vessel. The circuit for this arrangement is diagrammatically shown in FIG. 11. In this instance, it is preferable to select the elements 110 and 112 to have different ratings say 1.6 and 3.2 kilowatts respectively. The thermostat switch 116 is arranged to activate one or other of the elements 112, subject to the thermostat switch 114. On the other hand, the switch 120 is connected across the two elements so that if one of the elements is energised, so will the other. The optional bypass switch 118 can be connected in parallel across the switch 120 to effectively bypass the switches 116 and 120. The switches 114, 116 and 120 can be arranged as follows. The switch 114 opens above 75° C. and closes below 65° C., the switch 116 is connected to the circuit branch including the element 110 above 70° C. but changes to the branch including the element 112 at 40° C. The switch 120 closes below 40° C. and opens above 70° C. The arrangement is such that if a small volume of cold water is in the vessel, the low capacity element 112 will be activated. On the other hand if the level of cold water reaches the switch 116, it will energise the higher capacity element 112. On the other hand if the level of cold water in the vessel reaches the switch 120, the switch 120 will be closed and therefore both the elements 110 and 112 will be simultaneously energised.

It will be appreciated that when water heaters of the type shown in FIGS. 7 to 9 are used in an electric supply system with a night switch, the power drawn is roughly proportional to the quantity of water to be heated rather than in the usual case where all of the heaters are turned on at their maximum rate, regardless of the respective volumes of water to be heated.

Figure 10:
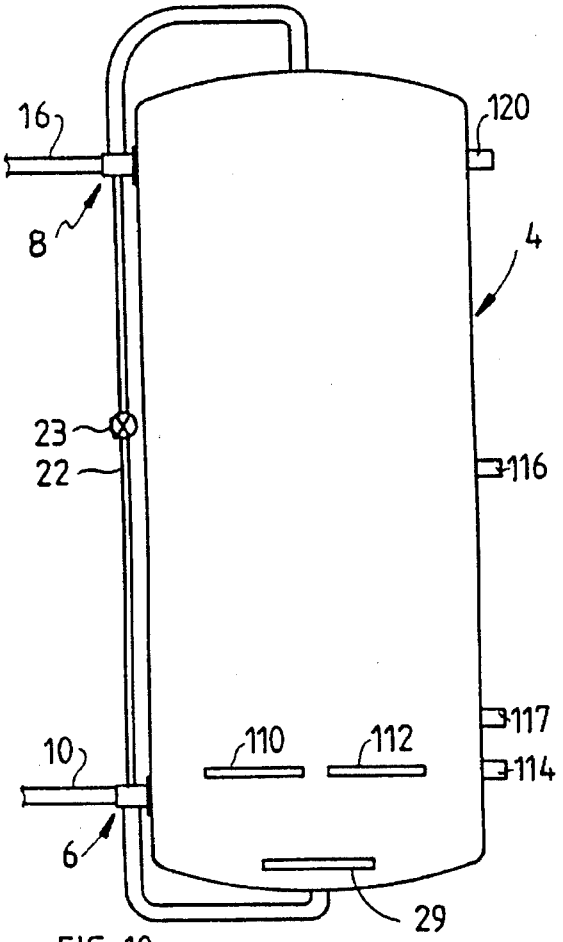
FIG. 10 is a hot water heater showing a second configuration of temperature sensing elements.
Figure 13:
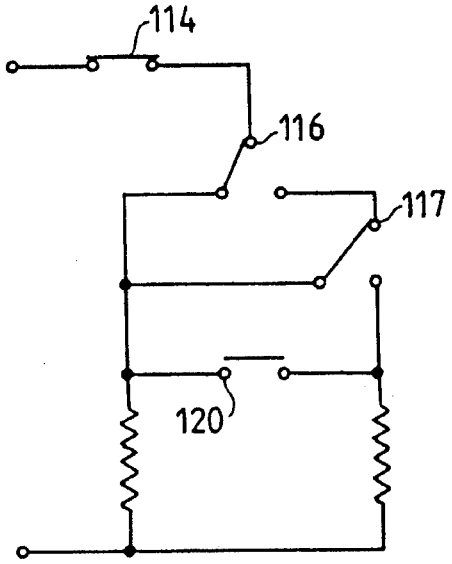
FIGS. 11 to 13 are circuit diagrams for the arrangement shown in FIG. 10.
Figure 11:
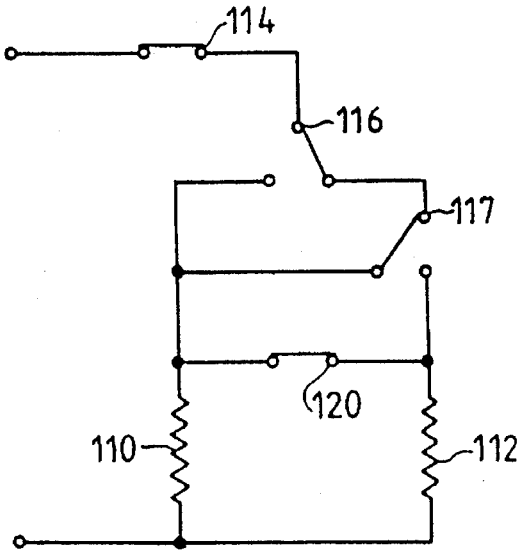
Figure 12:
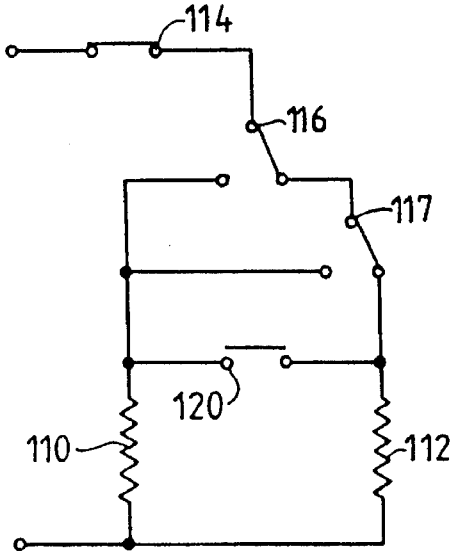

FIG. 10 shows a further modification in which a further temperature sensitive switch 117 is provided adjacent to or incorporated in the main thermostat switch 114. FIGS. 11 to 13 illustrate a suitable circuit connection for the elements 110 and 112. The function is generally analogous to that described above and therefore need not be described in detail.

FIGS. 14, 15 and 16 illustrate a preferred technique of forming an outer housing 152 about the vessel 4, particularly for the electrically energised arrangement shown in FIGS. 1, 7 and 10. The principles however would be applicable to gas fired arrangements. As best seen in FIG. 15, a layer 150 of insulating material is located between the vessel 4 and the housing 152. The housing may be formed from a single sheet of sheet metal and has a pair of flanges 154 and 156 formed at opposing edges, as best seen in FIGS. 14 and 16. The flanges do not extend fully to the upper and lower ends of the sheet. The housing includes a top cap 158, bottom tray 160, bracket 162 and elongate cover 164. The top cap 158 has a downturned flange which fits over the top edge of the cladding sheet 152, as seen in FIG. 15. The tray 160 on the other hand fits on the inside edge of the sheet 152. The tray 160 may include feet 166 for supporting the housing. The bracket 162 is fastened to the bottom edge of the cladding sheet 152 to provide a fixing point for the lower end of the cover 164.

During assembly of the housing, a clamping tool 167 engages the flanges 154 and 156 and draws them toward one another to thereby firmly clamp the insulating layer 150 between the cladding sheet 152 and the vessel 4. Fastening means such as screws 168 can then be applied through the sheet 152 into a plurality of fastening straps 170. The clamping means 166 can then be removed. The space between the flanges 154 and 156 can be left for providing access to heating elements or thermostat sensors and the housing 164 can be then placed over them to afford protection thereto. The cover 164 includes a top flange 172 which can be placed beneath the downturned flange on the top cap 158, as seen in FIG. 15. It will be appreciated that the cover 164 can be readily removed for servicing of the elements or sensors.

The principles of the invention are applicable to gas fired hot water heaters. FIGS. 17 to 23 illustrate schematically a gas fired hot water heater. In these Figures, some parts have been omitted for clarity of illustration and where appropriate the same reference numerals have been used as in the previous embodiments.

Figure 23:
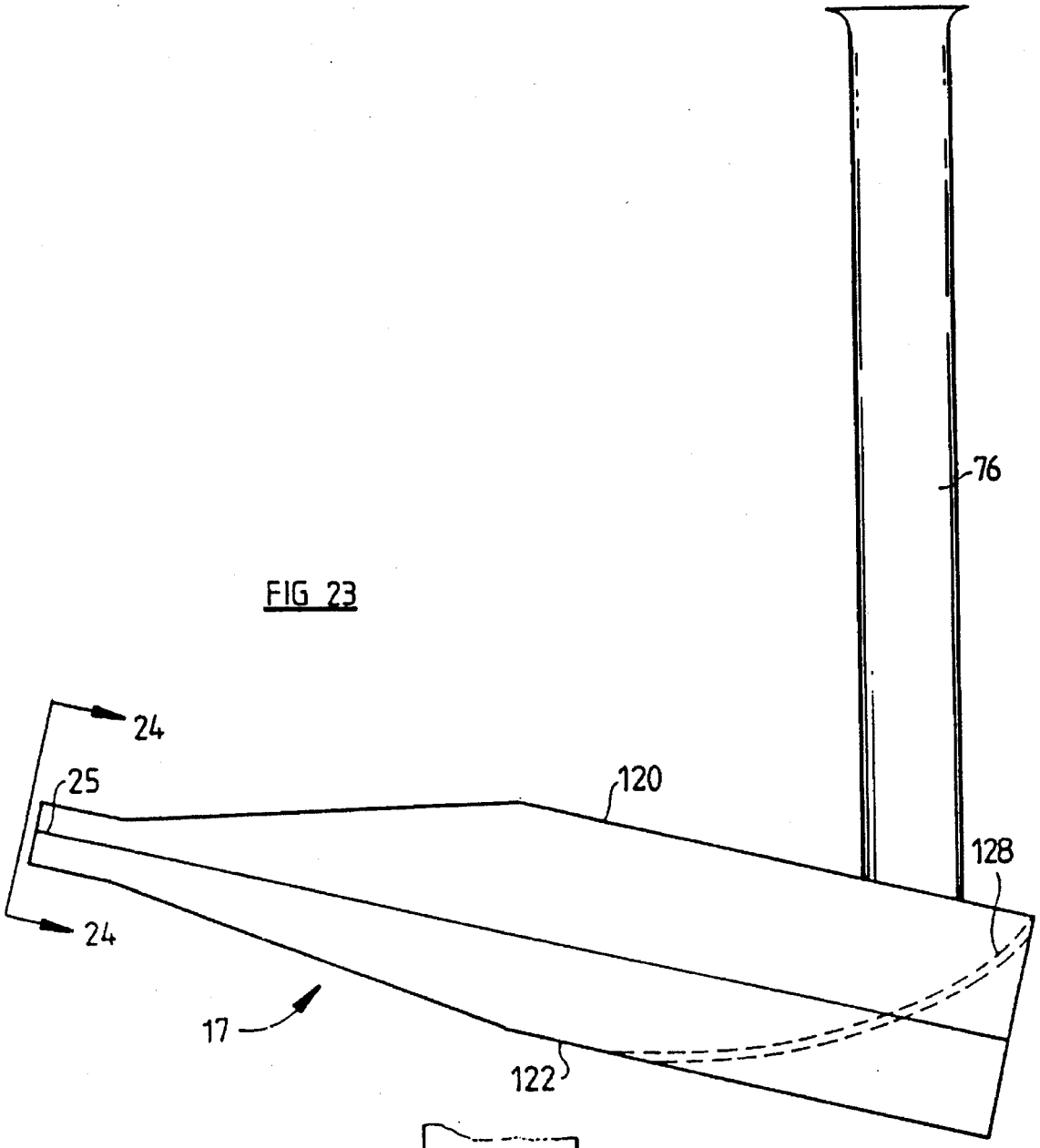
FIG. 23 is a side view of a burner of the invention.
Figure 24:
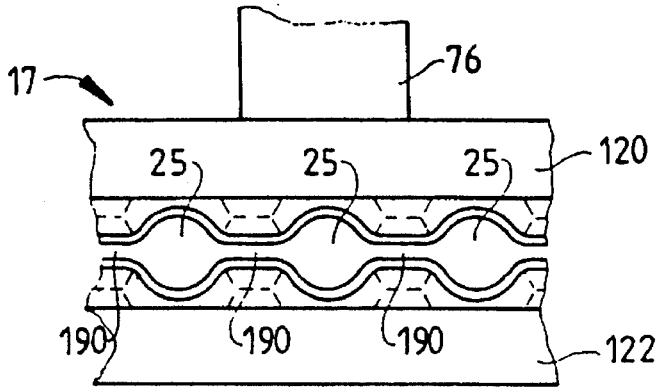
FIG. 24 is a fragmentary end view along the line 24—24.

The heater includes the bypass tube 22 and flow control valve 23 but these are not shown in the drawings. It has a cold water inlet 6 through the sidewall 29, near the bottom of the vessel, and a hot water outlet 8 located at the top of the vessel. Beneath the vessel 4 is a combustion chamber 11 the bottom of which is formed as a condensate tray 13 having an outlet 15. A burner 17 is located so as to project into the combustion chamber 11. More particularly, the combustion chamber includes an opening 19 through which the burner 17 passes. As best seen in FIGS. 23 and 24, the burner is generally wedge shaped and has a number of outlet orifices 25 on its narrow end.

Figure 17:
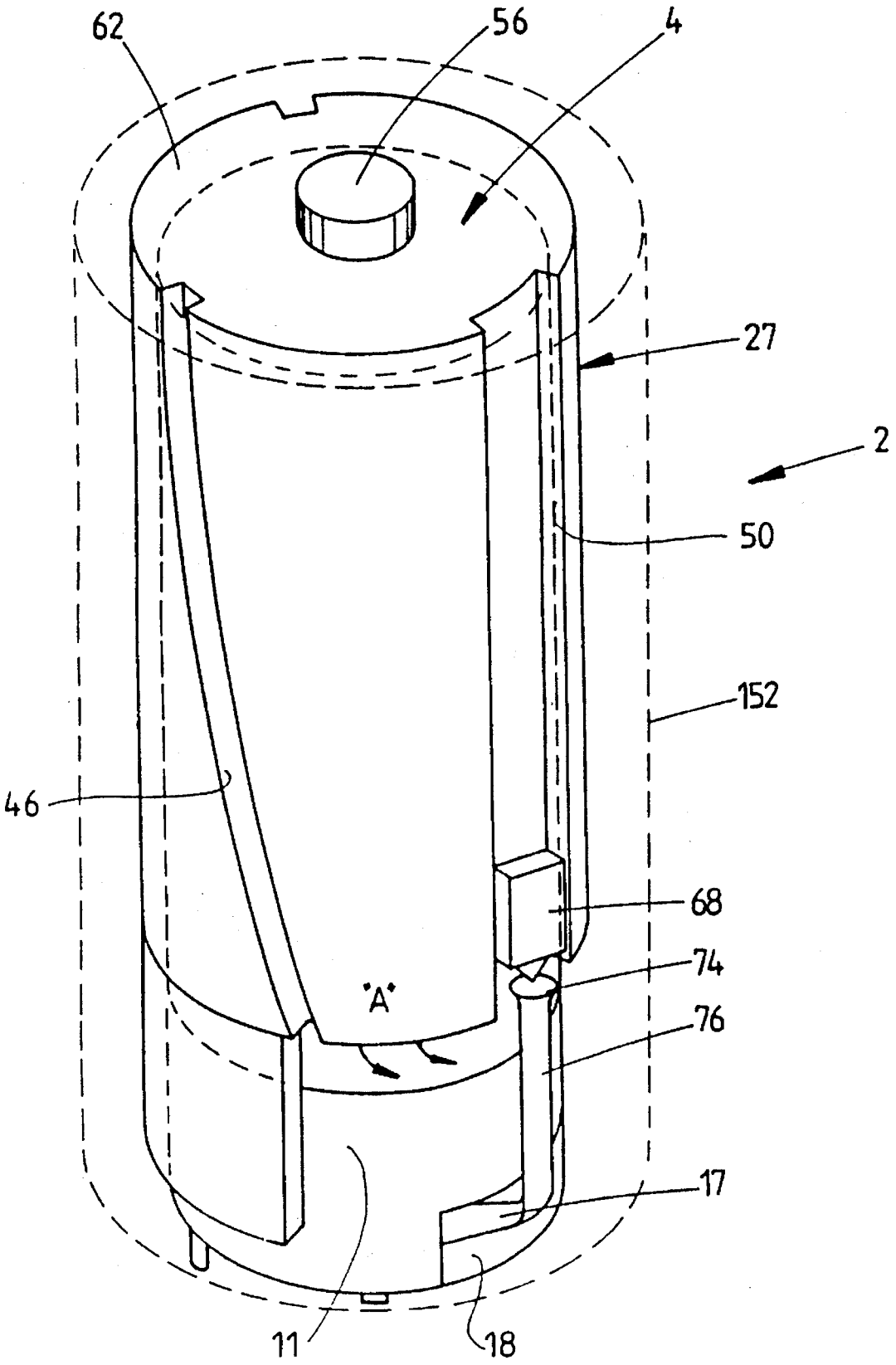
FIG. 17 is a schematic perspective view of a gas fired hot water heater embodying the principles of the invention.

The vessel 4 is surrounded by a partitioned flue structure 27 which, generally speaking, serves to direct hot combustion products from the chamber 11 upwardly adjacent to one side 29 of the vessel and then downwardly adjacent to opposed sides 32 and 33 (see FIG. 21) of the vessel and then to a balanced flue assembly 34, which is omitted in FIG. 17 for clarity of illustration. The flue structure 27 is shaped so as to keep the hot exhaust products away from the side 36 which is opposite to the side 29 which first receives the combustion products from the chamber 11. The side 29 is therefore very hot whereas the opposite side. remains relatively cool. This establishes a convection current indicated by wavy arrows 38. The circulating convection current tends to promote a more uniform temperature distribution in the water throughout the vessel. This is in contrast to other hot water heaters which normally have a more or less static body of water within them with a significant temperature differential between the top and bottom. The circulating current tends to avoid overheating at the top of the tank which might otherwise occur and, in addition, leads to a greater volume of hot water being available to the user at a more or less uniform temperature.

Figure 20:
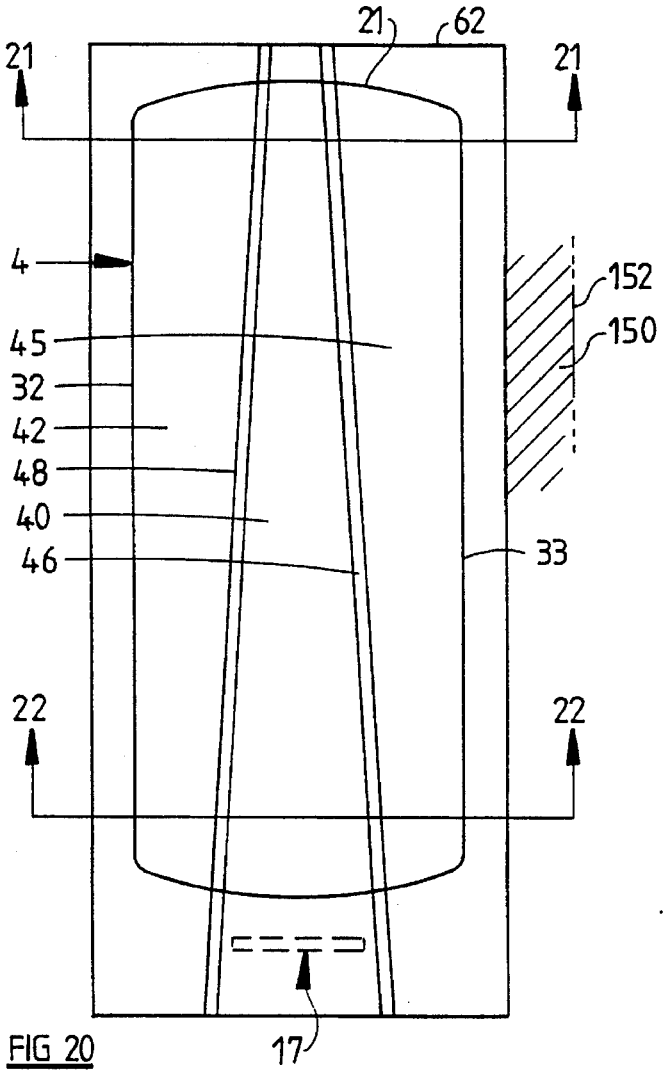
FIG. 20 is a schematic side view of the heater.
Figure 21:
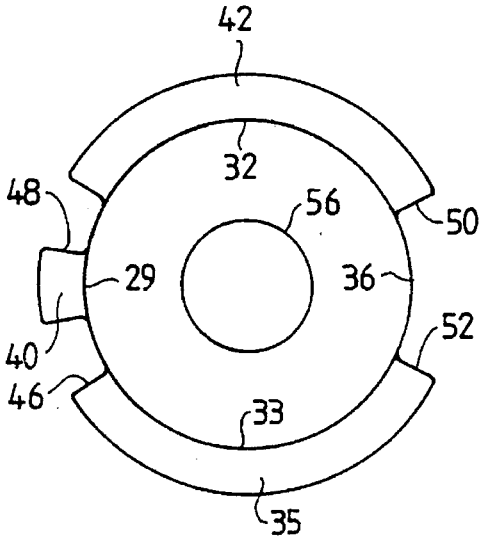
FIG. 21 is a cross-sectional view at line 21—21.
Figure 22:
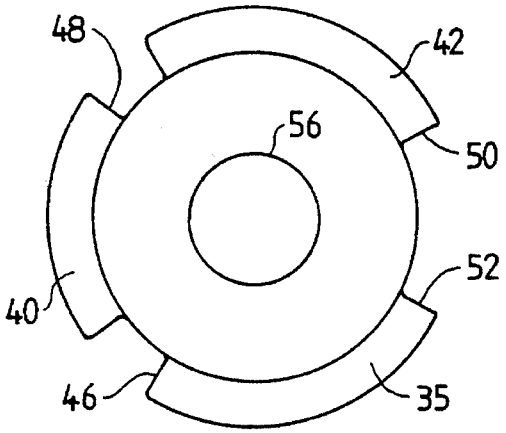
FIG. 22 is a cross-sectional view at line 22—22.

The flue structure 27 is preferably formed from a sheet of stainless steel or aluminized steel and is shaped so as to generally surround the vessel 4 and to define three exhaust ducts 40, 42 and 35 adjacent to the sides 29, 32 and 33 respectively. The structure 27 includes grooves 46 and 48 the inner ends of which bear against the outer periphery of the vessel 4, as best seen in FIG. 21. The grooves 46 and 48 define the boundary between the ducts 40 and the adjacent parts of the ducts 42 and 45. The other ends of the ducts 42 and 35 are defined by inturned legs 50 and 52 of the structure 27. As best seen in FIG. 20, the grooves 46 and 48 preferably taper towards one another in the upward direction so that the duct 40 decreases in cross-sectional area in the upward direction. This tends to promote more uniform heat transfer to the vessel along its length because at the bottom where the exhaust gases are hottest, the area of the duct is relatively wide. At the top, the exhaust gases have been cooled somewhat but are more concentrated owing to the smaller size of the duct 40. When the exhaust gases reach the top of the duct 40, they then pass adjacent to the top 21 of the vessel and then travel downwardly through the ducts 42 and 35, they then pass into the balanced flue structure 34. A heat shield 56 may be located near the centre of the top 21 of the vessel so as to prevent the exhaust gases from passing over that point. This avoids possible overheating at the top centre of the vessel. The shield preferably comprises a hollow cylindrical body which again may be made from stainless steel.

Figure 18:
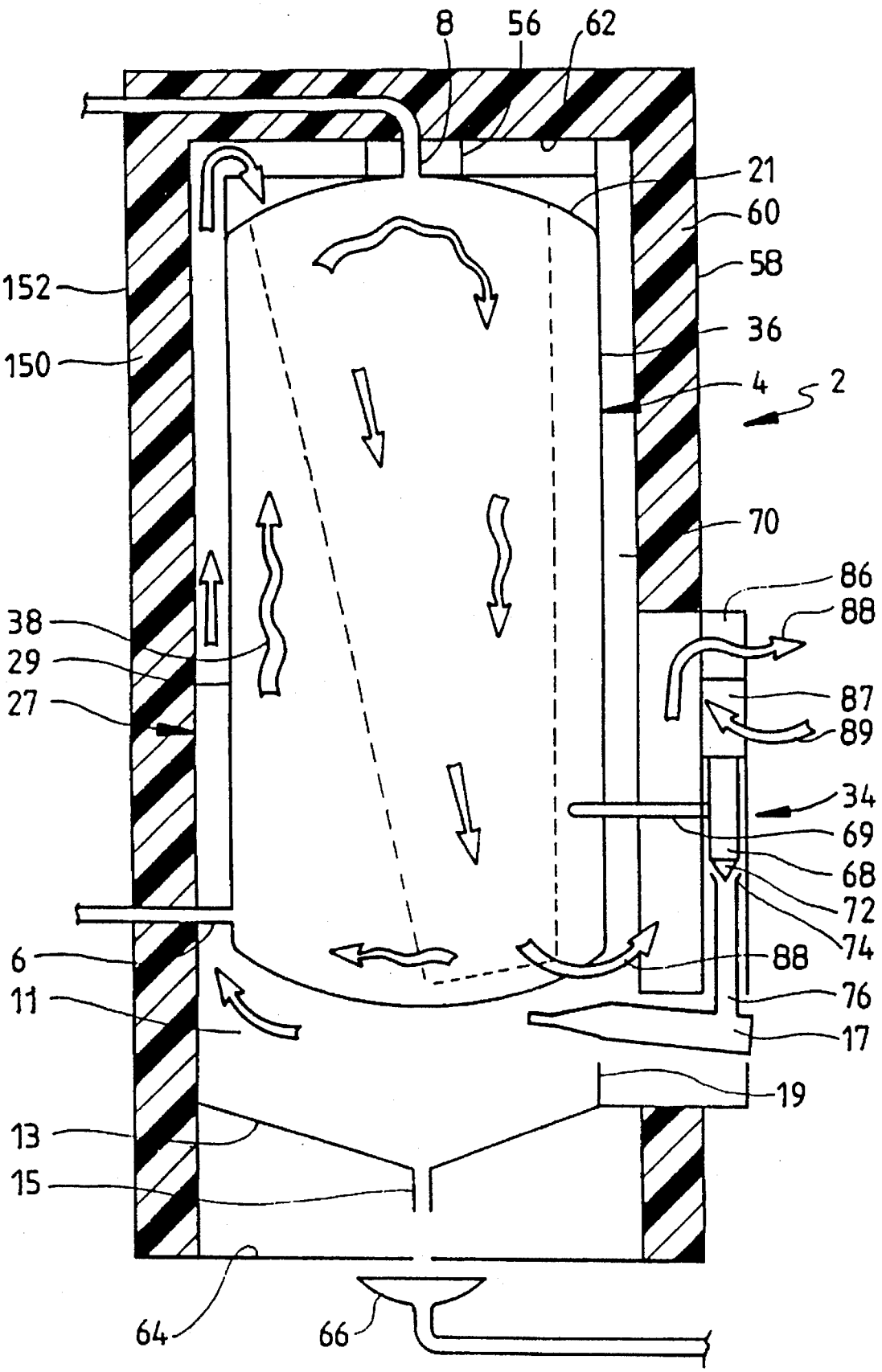
FIG. 18 is a schematic cross-sectional view of the heater of FIG. 17.

The vessel and flue structure are located within the housing 152 which is lined with insulating material 150, the housing 152 and insulating material 150 being shown in full in FIG. 18 and indicated in part only in FIG. 20. The flue structure 27 lies adjacent to the insulating material 150 and protects it from exposure to the exhaust gases. The insulation at the top of the vessel is protected by a plate 62. The housing 152 includes a base plate 64, a funnel 66 being provided to collect condensate from the outlet 15.

The heater includes a thermostatically controlled gas valve 68 which is located in the air inlet chamber of the balanced flue structures 34 and it functions in the usual way. A probe 69 extends into the vessel for sensing the temperature of the water and controlling the valve 68 in the usual way. The valve 68 includes an outlet nozzle 72 which is located adjacent to the flared end 74 of an inlet pipe 76 to the burner 17. Primary combustion air is drawn into the flared inlet 74 in the usual way.

Figure 19:
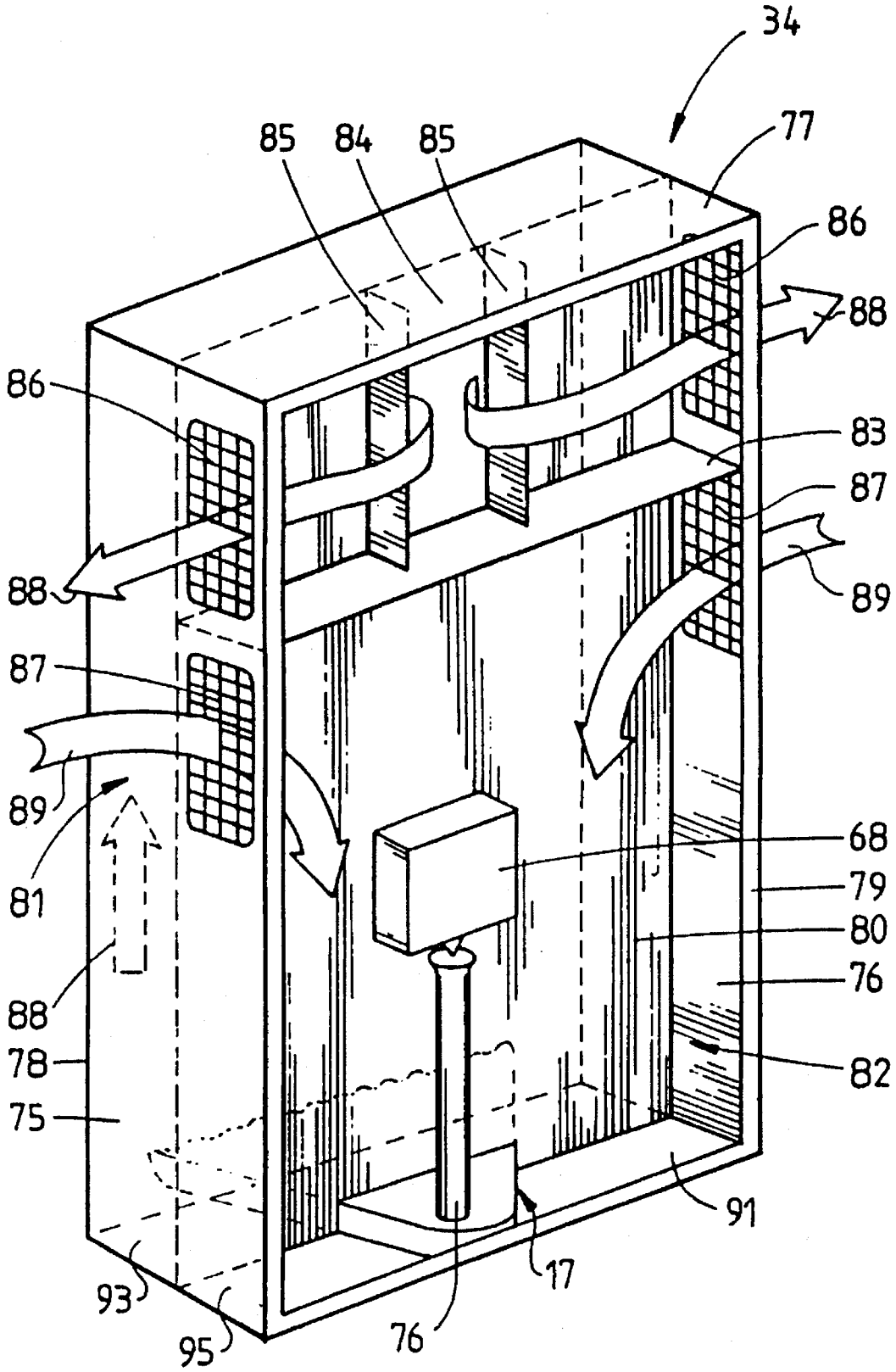
FIG. 19 is a fragmentary view of the flue assembly.

FIG. 19 schematically illustrates the balance flue structure 34. The structure 34 essentially comprises a box structure having sidewalls 75 and 76 and a top wall 77. The structure has an inner face 78 which is essentially open and lies adjacent to the flue structure 27. The box structure has an outer face which is open except for a flange 79 which extends inwardly from sidewalls 75, 76 and top wall 77 and across the bottom face 91 which is open at the inner part 93 and closed at the outer part 95. The outer face is closed by a removable cover (not shown) which permits access to the burner 17 and control valve 68. The box structure includes a partitioning plate 80 which is vertically disposed and forms an exhaust chamber 81 towards the inner face 78 of the structure and an inlet chamber 82 towards the outer face of the structure. It also includes a horizontally disposed plate 83 extending between the sidewalls 75 and 76 and the plate 80 and front face 79. The plate 83 defines a flue outlet chamber above it. The plate 80 includes a transfer opening 84 bounded by two baffle plates 85 to permit exhaust gases to pass from the chamber 81 into the outlet chamber and then through exhaust outlet grates 86 formed in the sidewalls 75 and 76. The sidewalls 75 and 76 also include air inlet grates 87 located beneath the grates 86 to permit air to be drawn into the inlet chamber 82. Because the grates 86 and 87 are located adjacent to one another, the arrangement acts as a balanced flue. Streams of exhaust gases, as indicated by arrows 88 from the exhaust passages 42 and 35, enter the lower part of the chamber 81 from beneath the lower edges of the exhaust structure 27 and then pass through the opening 84 and escape through the grates 86.

Inlet streams of air, as indicated by arrows 89 in FIG. 19, pass through the grates 87 downwardly through the chamber 82 and exit through the open bottom part 93 so as to then be drawn into the combustion chamber 11 to provide secondary air for the burner 17. Since the probe 69 passes through the exhaust chamber 81 it may include heat shielding to prevent overheating.

FIGS. 23 and 24 illustrate the preferred arrangement for the burner 17. The burner is generally wedge shaped and is formed from upper and lower pressed steel portions 120 and 122. The front edges of the portions 120 and 122 are formed with accurate grooved portions which cooperate to form the row of outlet orifices 25 with cross lighting gaps 190. The gas fuel inlet pipe 76 is connected near the rear part of the upper member 120 and an internal baffle 128 is provided so as to direct the gas air mixture towards the orifices 25. Mixing of the gases occurs in the body of the burner 17 as well as in the pipe 76. In use the burner 17 produces a row of flames which are located near the centre of the bottom of the vessel 4 and are directed generally towards the passage 40. Heat transfer will occur at the bottom of the vessel 4 as well as within the passages 40, 42 and 35.

Many modifications will be apparent to those skilled in the art without departing from the spirit and scope of the invention.

I claim:

1. A hot water heater comprising in combination;

a gas burner, a vessel having a bottom and holding water heated by the combustion products of the burner, the burner having a body with a rear part and a front part, a gas fuel inlet extending from the body at the rear part thereof, a row of outlet orifices at the front part of the body, the body tapering from the rear part where the inlet supplies gas to the burner body and towards the front part where the row of outlet orifices is located, the row of outlet orifices extending along a line of greater width than the rear part of the body so that gas from the inlet in the rear part of the body flows outwardly in a widening flow path through the body to emerge from the row of outlet orifices while at the same time flowing through the body which tapers towards the outlet orifices, the burner body being located so that at least the front part of the body is located beneath the bottom of the vessel, the body being arranged so that a plane which extends through the body and through the rear part of the body and through the row of outlet orifices is upwardly inclined towards the bottom of the vessel, the outlet orifices being arranged across the bottom of the vessel for directing flames across the bottom of the vessel, the inlet comprising an inlet pipe having an upper end, the inlet pipe having a substantially vertical axis and extending downwardly alongside the vessel to open into the rear part of the body of the burner so that the axis of the inlet pipe defines an acute angle to said plane extending through the row of outlet orifices and through the burner body to the rear part of the body, the hot water heater including means to inject fuel gas into the upper end of the inlet pipe so as to draw primary combustion air into the upper end of the inlet pipe to mix with the fuel gas whereby the fuel gas and primary combustion air flow down the inlet pipe around a curved path into the rear part of the body and upwardly through the tapering and widening path through the body to emerge through the row of outlet orifices and be ignited so that the flames are directed upwardly towards the bottom of the vessel and in a line across the bottom of the vessel.

2. A hot water heater as claimed in claim 1 wherein the inlet pipe opens into the rear part of the body of the burner through an upper wall of the body of the burner.

3. A hot water heater as claimed in claim 2 wherein the curved path through which the fuel and primary combustion gases flow from the inlet pipe into the body of the burner is defined by an internal curved baffle arranged within the body of the burner so that the gases entering the rear part of the body from the inlet pipe are directed along the curved baffle.

* * * * *